United States Patent [19]

Bung et al.

[11] Patent Number: 4,479,493

[45] Date of Patent: Oct. 30, 1984

[54] INHALATION APPARATUS FOR TEST ANIMALS

[75] Inventors: Richard Bung, Ludwigshafen; Hartmut Giesbrecht, Gross-Sachsen; Wolfgang Leuckel, Bad Durkheim; Hans-Joachim Klimisch, Weinheim, all of Fed. Rep. of Germany

[73] Assignee: BASF Aktiengesellschaft, Ludwigshafen, Fed. Rep. of Germany

[21] Appl. No.: 319,710

[22] Filed: Nov. 9, 1981

[30] Foreign Application Priority Data

Nov. 27, 1980 [DE] Fed. Rep. of Germany ..... 3044640

[51] Int. Cl.[3] ..... A61D 7/04

[52] U.S. Cl. ..... 128/204.18; 119/15

[58] Field of Search ..... 128/203.12, 204.18, 128/204.25, 205.19, 205.26; 119/15

[56] References Cited

U.S. PATENT DOCUMENTS

| | | | |
|---|---|---|---|
| 3,402,530 | 9/1968 | Agnon | 128/1 R |
| 3,464,388 | 9/1969 | Stout | 119/15 |
| 3,557,785 | 1/1971 | McQueen | 128/205.26 |
| 4,278,048 | 7/1981 | Klein | 119/15 |
| 4,348,985 | 9/1982 | Leong | 119/15 |

OTHER PUBLICATIONS

Sachsse et al., "Proceedings of the European Society for the Study of Drug Toxicity", vol. XV, Jun. 1973, pp. 239–251.

Raabe et al., "Toxicology and Applied Pharmacology" 26, (1973), pp. 264–273.

*Primary Examiner*—William E. Kamm

*Attorney, Agent, or Firm*—Keil & Weinkauf

[57] ABSTRACT

Inhalation apparatus for test animals for investigating the biological effect of substances mixed with respiratory air. It comprises a distributor chamber which is connected to a respiratory air preparation unit and has several openings, animal tubes connected to the openings and suction devices, connected to a disposal system, for removing the waste air. Each transition piece between the head and trunk of the animal tubes has holes connecting the animal tubes inserted into the apparatus to the suction devices.

11 Claims, 5 Drawing Figures

A–A

INHALATION APPARATUS FOR TEST ANIMALS

The present invention relates to an inhalation apparatus for test animals, for investigating the biological effect of substances mixed with respiratory air, comprising a distributor chamber which is connected to a respiratory air preparation unit and has several openings, animal tubes connected to the openings, and suction devices connected to a disposal system for removing the waste air.

Research laboratories have hitherto chiefly used inhalation apparatuses in which the respiratory air to be investigated is passed into a distributor chamber and from there is distributed via openings in the chamber wall to animal tubes which are connected thereto and occupied by the test animals. All the respiratory air flows past the test animals and into the environment at the end of the animal tube, or a part stream of the respiratory air is passed through the animal tubes, if the distributor chamber is connected to a waste air system (open pressurized procedure). The test animals, which are predominantly rodents such as rats, are thereby sufficiently exposed to respiratory air charged with substances of, in most cases, unknown toxicity, but the exposure is not only in the head/nose region but also over the entire body surface, which leads to undesirable contamination of the skin. Furthermore, at least some of the respiratory air passes into the environment, which in turn necessitates safety measures, such as a safe room and an aeration and extraction system for the room. Moreover, for safety reasons, apparatuses of this design can only be started up when occupied by animals, and undefined flow conditions prevail during the start-up period.

Apparatuses which operate by a closed suction procedure and in which the waste air volume removed per unit time is slightly greater than the volume of respiratory air introduced into the distributor chamber are also known. In order to prevent the respiratory air to be investigated being diluted by air from the environment, sucked in as a result of the reduced pressure, either the trunk of the animal tubes is closed at the end, or the distributor chamber and the animal tubes connected thereto are accommodated in a housing which is sealed off from the environment. Such systems are described in "Proceedings of the European Society for the Study of Drug Toxicity, XV, 1974", and Toxicol. Appl. Pharmacol. 26, (1973), 264–273. Pollution of the environment by the respiratory air flowing in the apparatus is substantially prevented, as is contamination of the skin. However, a constant and reproducible concentration of the respiratory air in the head/nose region of all the test animals is not achieved. As a result of the absence of aeration of the skin and of the build-up of heat in the animal tubes, a stress condition in the animals must also be reckoned with. A further disadvantage is that the housing makes it difficult to manipulate the apparatus in respect of placing the animals in the tubes. It is not possible to remove test animals during the exposure without disrupting the course of the experiment. However, premature removal is sometimes necessary for pathological investigations and observations.

It is an object of the present invention to provide an inhalation apparatus for test animals which operates under suction, in order to avoid contamination of the environment, and enables the animal tubes to be aerated, with air from the environment, in the region of the body of the animal. For the inhalation experiments to be reproducible, a respiratory air concentration which is substantially constant with respect to volume and to time must be ensured for all the test animals, regardless of whether all or only some of the animal tubes are connected to the apparatus. In the design of the inhalation apparatus, easy manipulation and ease of observation of the animals were to be taken into consideration.

We have found that this object is achieved by an inhalation apparatus of the type described above, wherein a suction chamber is connected to the side of the distributor chamber which has the openings, and the transition pieces between the head and trunk of the animal tubes have holes connecting the animal tubes inserted into the apparatus to the suction chamber.

A preferred embodiment of the invention provides an inhalation chamber in which channels which are sealed off from the suction chamber run along the inside of the suction chamber, on the one hand merging into the distributor chamber at the openings and on the other hand ending in openings in the outer wall of the suction chamber, and the heads of the animal tubes inserted in the apparatus partly project into the individual channels, the wall of which surrounds the free head end of the animal tubes, and each of the channels has an extension which projects beyond the openings in the outer wall and forms an annular gap with a ring-shaped shoulder of the animal tubes, the section of the channel wall adjacent to the head of the animal tubes being provided with passages.

As a result of forcing the respiratory air from a distributor chamber into a separate suction chamber, directly if no animal tubes are attached, or otherwise via the head of the tubes, no harmful substances pass into the environment whether the animal tubes are occupied or not. Moreover, virtually no harmful substances come into contact with the body surface of the animals (thus avoiding skin contamination). The apparatus can therefore remain freely accessible at all times. It is thus possible, for example, to connect up or remove animal tubes whilst the apparatus is running, constant experimental conditions prevailing for all the test animals throughout the entire exposure period.

Further advantages and details of the inhalation apparatus according to the invention can be found in the Examples described below with the aid of the drawing.

Figure 1:
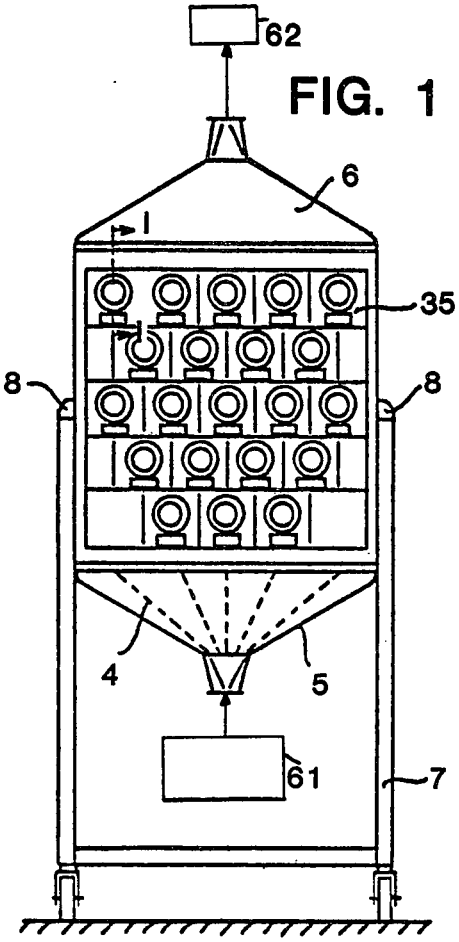
FIG. 1 shows a front view of the inhalation apparatus.
Figure 2:
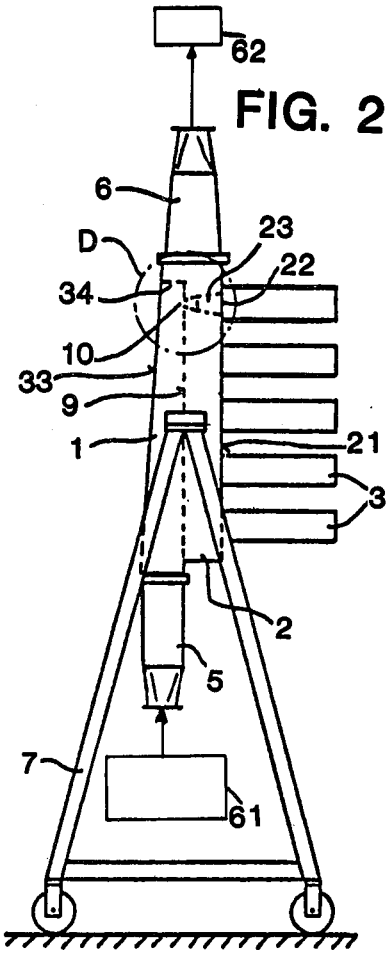
FIG. 2 shows a side view of the inhalation apparatus.
Figure 3:
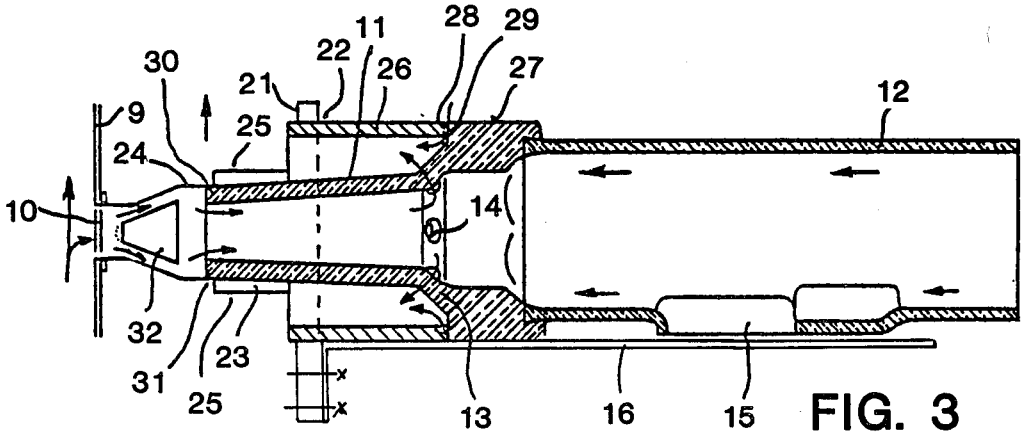
Figure 4:
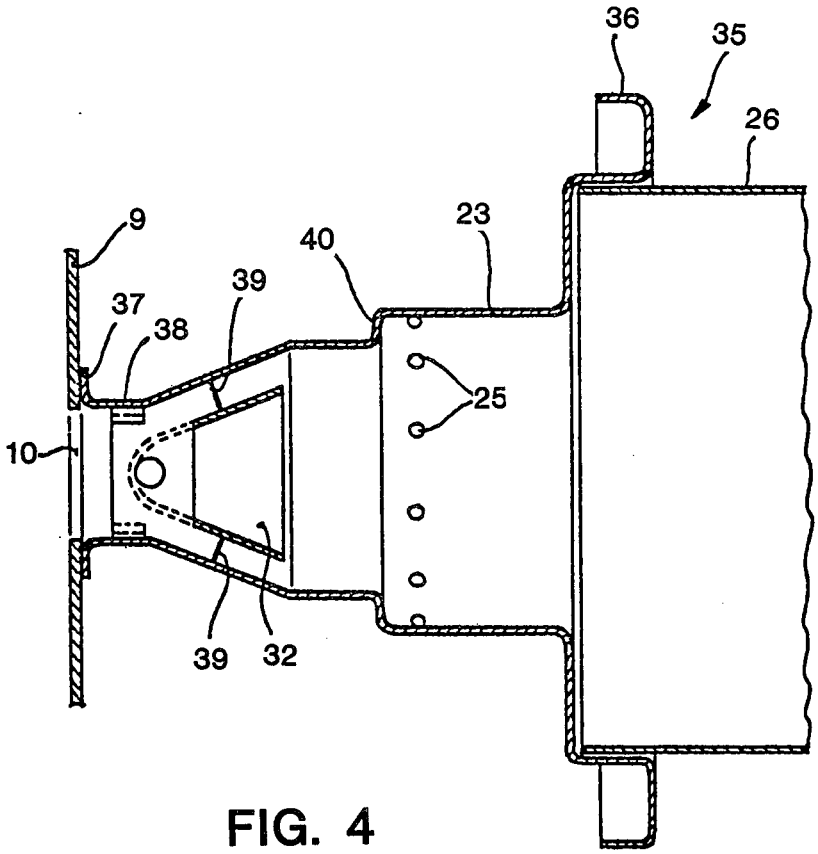
Figure 5:
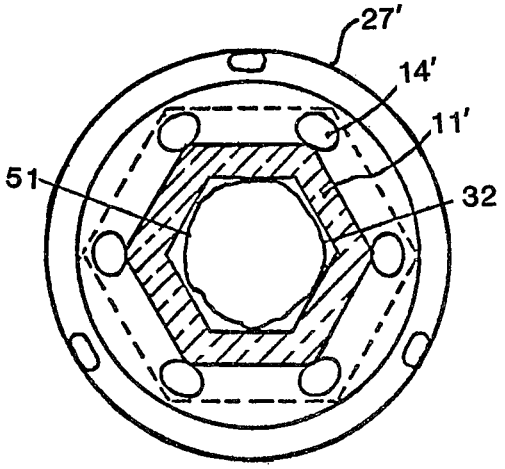

FIG. 3 shows a portion of the apparatus corresponding to a detailed view of the circle D in FIG. 2, in the section I—I of FIG. 1, FIG. 4 shows a longitudinal section of a wall element of the inhalation apparatus, and FIG. 5 schematically indicates, by a sectional view taken at a location corresponding to that of line A—A in FIG. 3 a modification of the apparatus shown in FIGS. 1 to 4, in which the head of the animal tube has a hexagonal cross-section.

The inhalation apparatus is represented diagrammatically in FIGS. 1 and 2. It essentially comprises a distributor chamber 1, a suction chamber 2 which runs parallel to this distributor chamber and immediately adjacent thereto, and animal tubes 3 which can be connected to these chambers. The distributor chamber 1 is connected, via a supply hood 5 equipped with guide plates 4, to a respiratory air supply unit 61 schematically indicated in the drawing, in which the harmful substances to be investigated toxicologically are mixed with the respiratory air. The suction chamber 2 is connected to a disposal system (not shown in the drawing), which is under reduced pressure, via a collecting hood 6 opposite thereto in the direction of flow, in order to extract the waste air. Central screwed unions, which can be removed for easier cleaning, are provided between the chambers 1 and 2 and the two hoods 5 and 6, which are manufactured from stainless steel sheet which can be deep-drawn.

For easy handling and flexible use, the entire inhalation apparatus is kept in a movable stand 7 and can be rotated about a horizontal axis by means of pivot bearings 8.

A wall 9 separating the distributor chamber 1 and the suction chamber 2 has several rows of openings 10, to which the head ends of the animal tubes 3 can be connected directly or indirectly.

The animal tubes 3 (FIG. 3) are made of transparent plastic or glass and are each composed of a head 11 and trunk 12 joined by a transition piece 13. The transition piece is provided with holes 14 which are distributed around the periphery in the form of bores. A recess 15 for the animal's droppings is provided in the trunk of the animal tube. The head of the animal tube has a circular or polygonal, preferably hexagonal, cross-section. The tube thus cannot be closed off by the head of the test animal, thus ensuring reliable flow through the head of the tube. For this reason, it is also advantageous to locate the holes 14 in each of the corners of the polygon.

The modification just described in which the head of the animal tube has a hexagonal cross-section has been schematically indicated in FIG. 5 which is a sectional view taken at a location corresponding to that of line A—A in FIG. 3. In FIG. 5, parts generally similar to parts shown in FIG. 3 have been designated by corresponding but primed reference numerals. The generally circular contour 51 of the head of the test animal has also been shown in FIG. 5 and the ventilation channels left between the head of the animal and the inside of the corners of the hexagonal head section 11' of the animal tube has been designated as 52.

The holes, in which, as will be seen later, reduce pressure prevails, and their position in the animal tubes mean that on the one hand the respiratory air from the distributor chamber 1 necessarily flows over the head of the animal and, on the other hand, air from the environment is sucked into the apparatus through the tube trunk 12, so that sufficient aeration of the skin of the animal is ensured. Closing off of the animal tube by the test animal can also be prevented by providing at least the head 11 with axially parallel ventilation channels of a different kind than that just described.

Supports 16 connected to the outer wall 21 of the suction chamber 2 are provided in order to fix the animal tubes 3 inserted into the inhalation apparatus.

The reduced pressure at the holes 14 in the transition piece 13 of the animal tubes 3 can be achieved, for example, by an arrangement in which the animal tubes attached to the openings 10 of the distributor chamber 1 are completely or partly, but in that case at least up to the transition piece 13, within the suction chamber 2. The suction chamber is thereby opened to the trunk end of the animal tubes to such an extent that the animal tubes can be brought up to the openings 10 or removed therefrom and air from the environment can be sucked between them into the suction chamber. This air additionally sucked in, the amount of which should be about 5 to 9 times the amount of respiratory air fed into the suction chamber, directly in the case of a free opening 10 or through the head 11 of the animal tube if the opening is occupied, means that the total waste air conveyed via the collecting hood 6 into the disposal system is substantially independent of whether animal tubes are inserted into the openings 10.

FIGS. 2 and 3 show an embodiment of the inhalation chamber according to the invention, in which the outer wall 21 of the suction chamber 2 is set back to the level of the head 11 of the animal tube 3, so that when the animal tube is inserted, the transition piece 13 with the holes 14 lies outside the chamber. As a result, the animal tubes can easily be handled and the test animals inside them can readily be observed. Channels 23 which, apart from the passages 25 referred to hereinafter, are sealed off from the pressure chamber 2 and narrow towards the openings 10 extend from the openings 10 in the wall 9 to the openings 22 in the outer wall 21. These channels 23 have, in the region of the head 11 of the animal tubes 3 which is to be accommodated, passages 25 in the form of bores in the channel wall 24, distributed around the periphery of the channel. The channels 23 are extended at the outer wall openings 22 by cylindrical projections 26, up to the transition piece 13 of the inserted animal tubes 3, the projections and a ring-shaped shoulder 27 of the animal tubes in each case forming an annular gap 28 between the opposite faces. The projection 26 and the shoulder 27 can of course also be such that their peripheral surfaces face one another to form a concentric annular gap. Spacer studs 29 on one of the surfaces ensure a defined annular gap.

As a result of these design features, the holes 14 in the animal tubes 3 are in the region over which the suction chamber is effective, so that both the respiratory air fed in through the head 11 of the animal tubes, and the air from the environment, which flows in through the trunk 12, are sucked via these holes into the projection 26 of the channels 23. The air mixture constituting the waste air is removed into the suction chamber via the passages 25 in the channel wall 24, together with further air from the environment which is sucked in through the annular gap 28 in an amount from 5 to 9 times the amount of respiratory air. This air flow means that the respiratory air intended for inhalation by the animal cannot pass into the environment surrounding the inhalation apparatus. This is so even if no animal tubes are inserted, since in this case the respiratory air is sucked from the opening 10 in the distributor chamber 1 directly to the passages 25.

As a result of the conical shape of the head 11, the free head ends 30 of the animal tubes inserted into the apparatus are surrounded by the channel wall 24 to a greater or lesser extent, depending on the depth to which they project into the channels 23, so that, with the aid of the resulting annular gap 31, a secondary stream of respiratory air results, and the amount of air flowing over the head of the test animal can thus be adjusted.

In order to achieve a reproducible concentration of respiratory air which is the same for all the test animals and remains constant, it is necessary to ensure that the respiratory air is not diluted by the air from the environment which flows into the apparatus, especially through free openings 10 in the distributor chamber wall 9. Undesired entry of air into the distributor chamber is prevented by reducing the diameter of the openings 10. This undesired entry of air is further remedied by locating a conical displacement body 32 in the region of the openings 10 at a distance from the head end 30 of the inserted animal tubes approximately corresponding at least to its diameter, so that a uniform flow of respiratory air can again be established in the body 11.

As can be seen from FIG. 2, the distributor chamber 1 narrows towards the top as a result of a slight slope in the chamber outer wall 33, so that the chamber cross-section is reduced, in view of the volumetric flow rate of respiratory air decreasing in the direction of flow. Because there is little loss in pressure along the stream of waste air, a corresponding increase in the cross-section of the suction chamber 2 is not necessary.

Furthermore, the distributor chamber 1 is perforated at the top on the side of the suction chamber 2 by bores 34 or other forms of openings so that vertical distribution of the respiratory air in the distributor chamber is assisted by the part-stream thereby fed directly into the suction chamber. The effect of animal tubes on the pressure and flow conditions in the channels 23 is also reduced thereby.

The flow chart which follows illustrates the volumetric flow distribution in the inhalation apparatus (for 21 animal tubes). The figures shown relate to an operating example. Other operating parameters can, of course, also be chosen, depending on the size of the apparatus and on the aim of the investigation.

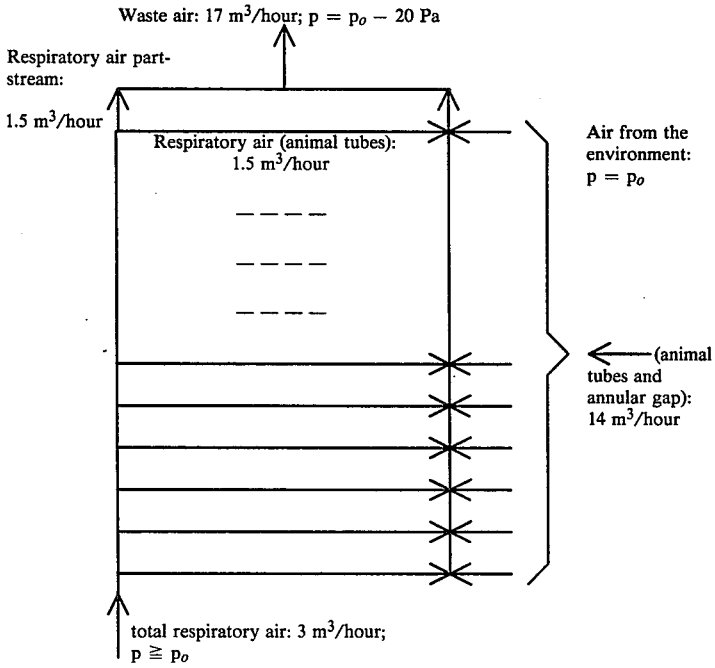

The arrows shown in FIG. 3 further illustrate the air flows in the apparatus.

In building the inhalation apparatus, so as to obtain a stable but light construction, it is advantageous to produce individual wall elements 35 (FIG. 4) with a deep-drawn channel part 23 and to join the angled periphery 36 of each element to the outer wall 21 of the suction chamber 2 by welding, for example spot-welding. The separating wall 9 is similarly connected to the channel section ends 38, which narrow and are shaped into a collar 37, of the wall element at the openings 10. Subsequently, the remaining wall sections can be fitted, and the distributor chamber 1 and the hoods 5 and 6 can be constructed, in the manner with which the skilled worker is familiar.

The displacement bodies 32 are attached to the inner wall of the channel parts 23 by means of webs 39. The passages 25 are close to the enlargement 40. The projections 26 are inserted into the channels 23 to form a frictional connection.

We claim:

1. An inhalation apparatus for test animals, for investigating the biological effect of substances mixed with respiratory air, comprising:

a distributor chamber which is to be connected to, and supplied with the mixture under pressure by, a respiratory air preparation unit, a suction chamber which is to be connected to, and held under subatmospheric pressure by, a disposal system for removing the waste air and air from the environment, said suction chamber being disposed adjacent to, and being secured to said distributor chamber, and having therein on its side facing the outside of said apparatus a plurality of apertures, and said distributor chamber having therein on its side facing said suction chamber a plurality of openings in alignment with the corresponding apertures of said suction chamber, and animal tubes having a head section, a trunk section and a transition section therebetween, and means defining a channel extending between each said aperture in the suction chamber and the corresponding opening in the distributor chamber, said channel defining means receiving an animal tube in such a manner that, upon insertion of said animal tube through said aperture into said channel defining means, communication is established between the head section of said animal tube and the distributor chamber, said transition section having holes through which the respective tube, upon insertion, communicates with the suction chamber so that by way of said holes both respiratory air passed through said head section and environmental air passed, in the opposite direction, through the open end of said trunk section, are withdrawn.

2. An inhalation apparatus as claimed in claim 1, wherein said channel defining means are dimensioned so as to form an intermediate spacing radially between an inserted animal tube and the channel defining means, and wherein said channel defining means have passages therein affording communication between said intermediate spacing and said suction chamber through the channel defining means.

3. An inhalation apparatus as claimed in claim 2, wherein the transition section of said animal tube, adjacent its end adjoining the head section, has a ring-shaped shoulder, wherein said passages are in the section of the channel defining means adjacent the head section of the animal tube, and wherein each of the channel defining means has an extension which, in the direction away from the distributor chamber, projects beyond the apertures in the wall of the suction chamber and forms an annular gap with said ring-shaped shoulder.

4. An inhalation apparatus as claimed in claim 2 or 3, wherein the diameter of the channel defining means decreases towards the respective opening in the distributor chamber so as to match the diameter of the opening.

5. An inhalation apparatus as claimed in claim 2, wherein each said channel defining means is attached at one end to said wall of the suction chamber at the location of the respective one of said apertures.

6. An inhalation apparatus as claimed in claim 2 or 3, wherein the channel defining means is shaped so that adjacent the open end of the head section of each inserted animal tube a ring-shaped gap is formed between said end and the corresponding portion of the channel defining means surrounding said section at said end so that a secondary stream of respiratory air bypassing the interior of said head section is permitted to pass directly into said passages.

7. An inhalation apparatus as claimed in claim 1, wherein a conical displacement body extending coaxially in said channel is centrally located in the region of each opening of the distributor chamber to promote the uniform flow of respiratory air in said head section and reduce the entry of air into the distributor chamber through said opening and directing the respiratory air to the suction chamber if no tube is inserted.

8. An inhalation apparatus as claimed in claim 1, wherein the distributor chamber has perforations at its end viewed in the direction of flow, leading to the suction chamber.

9. An inhalation apparatus as claimed in claim 1, wherein the inside of at least the head section of the animal tube has an other than circular cross-section to provide for axially parallel ventilation channels.

10. An inhalation apparatus as claimed in claim 9, wherein at least the head section of the animal tubes has a polygonal cross-section.

11. An inhalation apparatus as claimed in claim 9 or 10, wherein the holes in the transition section between the head section and trunk section of the animal tubes are located adjacent the ventilation channels.

* * * * *